United States Patent [19]

Cohn

[11] 4,052,923

[45] Oct. 11, 1977

[54] ELECTRICAL CONTROL DEVICES

[76] Inventor: James Myron Cohn, 1125 Lexington Ave., New York, N.Y. 10021

[21] Appl. No.: 698,644

[22] Filed: June 22, 1976

[51] Int. Cl.[2] ..... G10H 3/00

[52] U.S. Cl. ..... 84/1.07; 84/1.18; 84/DIG. 7

[58] Field of Search ..... 84/1.01, 1.17, 1.18, 84/1.24–1.27, DIG. 7, 1.06–1.1; 338/69

[56] References Cited

U.S. PATENT DOCUMENTS

| | | | |
|---|---|---|---|
| 2,544,466 | 3/1951 | Meagham | 84/1.17 |
| 3,045,522 | 7/1962 | Markowitz et al. | 84/1.18 |
| 3,513,247 | 5/1970 | Anderson et al. | 84/1.18 |
| 3,558,793 | 1/1971 | Nakada | 84/1.01 |
| 3,562,399 | 2/1971 | Yamauchi | 84/1.25 |
| 3,564,104 | 2/1971 | Reynolds | 84/1.01 |
| 3,609,201 | 9/1971 | Adachi | 84/1.01 |
| 3,609,203 | 9/1971 | Adachi | 84/1.01 |
| 3,624,583 | 12/1971 | Nakada | 84/1.24 X |
| 3,624,584 | 11/1971 | Ohno | 84/1.24 X |
| 3,626,350 | 12/1971 | Suzuki | 338/69 |
| 3,634,593 | 1/1972 | Nagano | 84/1.01 |
| 3,657,459 | 4/1972 | Peterson | 84/1.01 |
| 3,657,460 | 4/1972 | Cutler | 84/1.01 |
| 3,663,736 | 5/1972 | Tomisala | 84/1.24 |
| 3,694,559 | 9/1972 | Suzuki et al. | 84/1.01 |
| 3,699,492 | 10/1972 | Yoshihara | 338/69 |
| 3,800,059 | 3/1974 | Pavia | 84/1.24 |
| 3,818,114 | 9/1974 | Okamoto | 84/1.25 |
| 3,835,235 | 10/1974 | Amano | 84/1.24 |
| 3,960,044 | 6/1976 | Nagai et al. | 84/1.01 |
| 3,965,789 | 6/1976 | Pearlman | 84/1.24 |

*Primary Examiner*—Robert K. Schaefer
*Assistant Examiner*—Vit W. Miska
*Attorney, Agent, or Firm*—Ladas, Parry, Von Gehr, Goldsmith & Deschamps

[57] ABSTRACT

An electrical control device comprises a base member, and an elongate support member mounted to be movable transversely of its length with respect to the base member. A tension spring biases the elongate member against movement in one direction transversely of its length and towards a null position. An elongate resistive member is supported by and extends along the length of the support member, and when the ends of the resistive member are connected to opposite respective poles of a voltage source a sensing electrode can be applied to the resistive member to tap off a voltage which is selectively variable by varying the position along the support member at which the sensing electrode is applied to the resistive member. The resistive member is so arranged with respect to the support member that application of the sensing electrode to the resistive member tends to bring about movement of the elongate member with respect to the base member in opposition to the bias established by the tension spring. A position pick-up has a first part connected to the support member and a second part connected to the base member, and the parts are arranged and connected to generate an electrical analog signal dependent on the position of the support member with respect to the base member. The device is also provided with means for generating a predetermined response when the support member is moved from the null position through an initiating threshold position against the bias established by the tension spring and for terminating the response when the support member is returned from beyond the initiating threshold position towards the null position through a termination threshold position.

11 Claims, 8 Drawing Figures

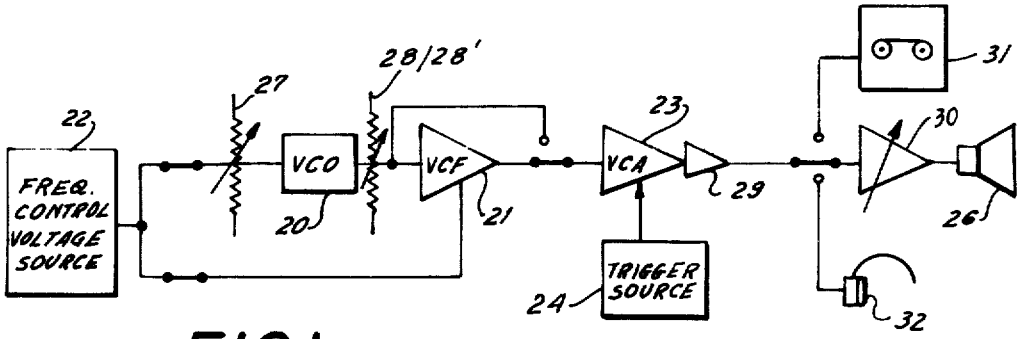
FIG.1
FIG.2
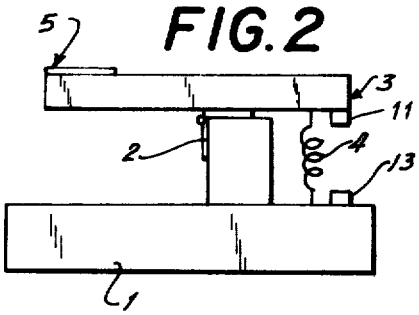
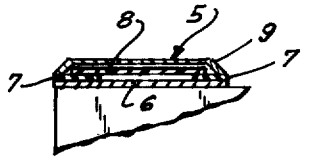
FIG.2A
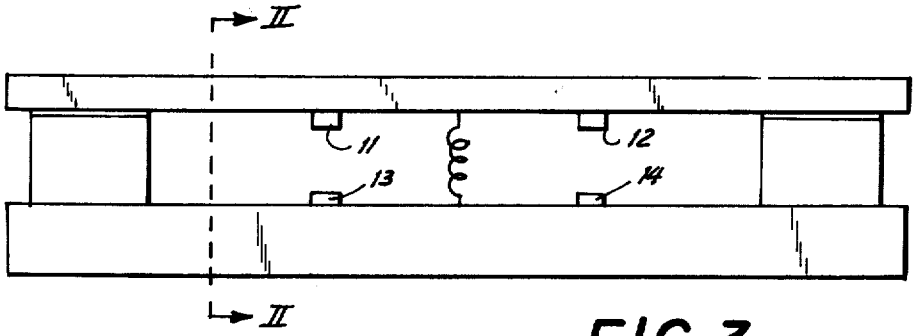
FIG. 3
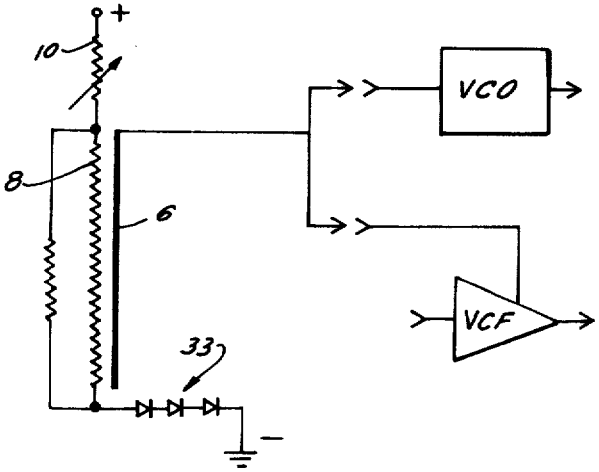
FIG.4

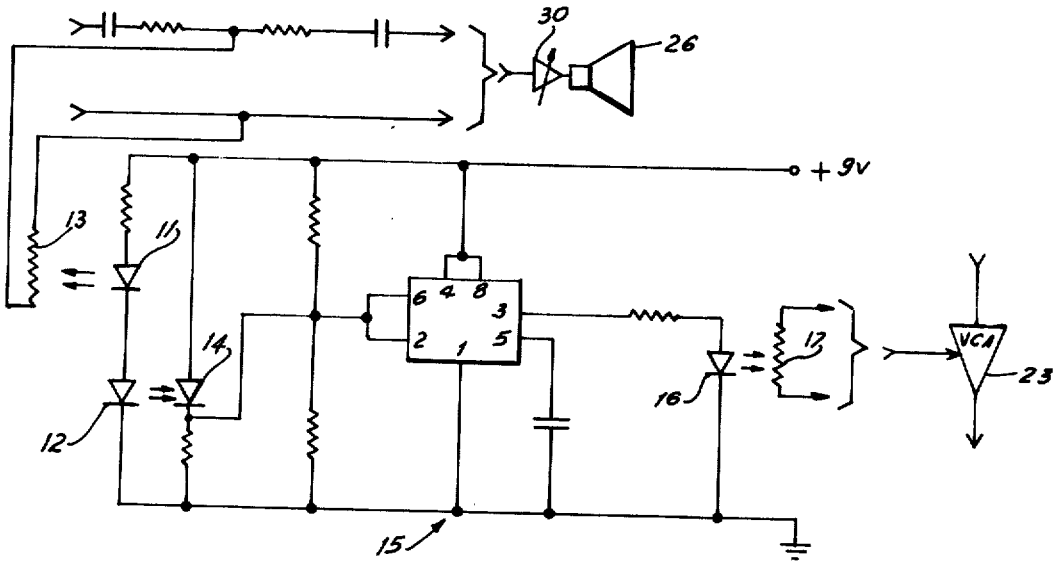
FIG. 5
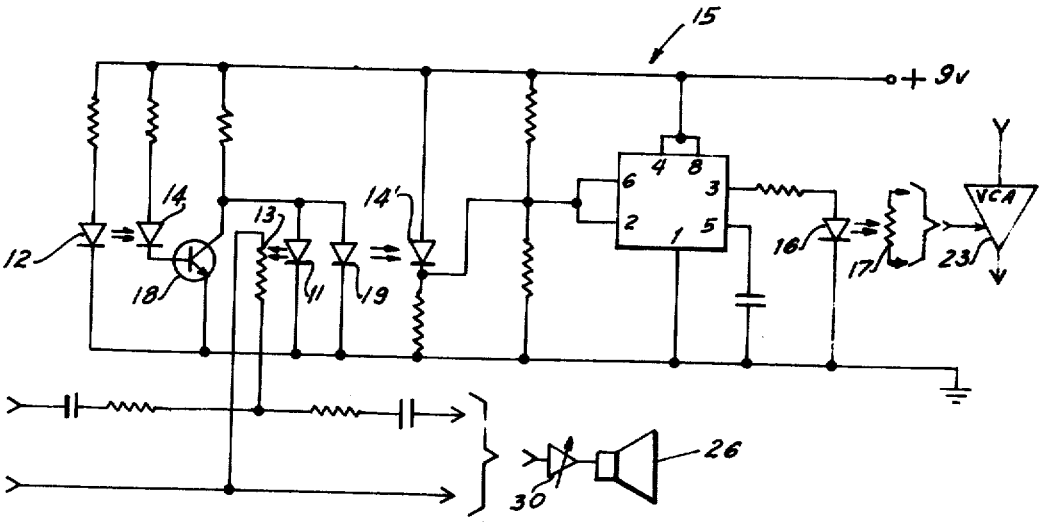
FIG. 6
FIG. 6A
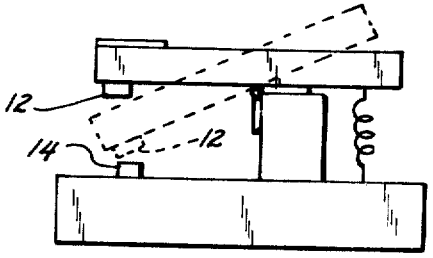

ELECTRICAL CONTROL DEVICES

This invention relates to electrical control devices, and is particularly useful in providing a control for an electronic music synthesizer, an electronic musical instrument or one or more electronic music modules.

A known type of music synthesizer comprises a voltage controlled oscillator (VCO) and a voltage controlled filter (VCF). The VCO has two outputs at one of which is provided a square wave signal and at the other of which is provided a triangular wave signal. These two outputs are connected through respective isolation resistors to a common bus which is connected to one fixed pole of a two-pole selector switch, and is also connected through another isolation resistor to the input of the VCF, whose output is in turn connected to the other fixed pole of the selector switch. The movable pole of the selector switch is connected to the input of a voltage controlled amplifier (VCA), which provides the synthesizer's output signal, and accordingly the selector switch enables the user of the synthesizer to determine whether the output signal is derived from the unfiltered output(s) of the VCO, or from the output(s) of the VCO as modified by the VCF.

The fundamental frequency of the VCO's output signal, be it the square wave signal or the triangular wave signal, is determined by applying a controlling voltage to the VCO. Likewise, when the VCF is used, the manner in which the VCF modifies the signal(s) from the VCO can also be determined (if so desired) by applying the controlling voltage (through additional switches) to the VCF also. The source of the controlling voltage may be a ribbon controller comprising a strip of resistive material connected at its opposite ends to a DC voltage source, and a conductive probe whereby the voltage at any point along the resistive strip can be tapped to provide the controlling voltage for the VCO and possibly also for the VCF. Thus the position at which the probe is touched to the resistive strip determines the frequency of the signal applied through the selector switch to the VCA.

The amplitudes of the two output signals provided by the VCO are controlled separately from the frequency, by means of respective conventional potentiometers. Finally, the synthesizer circuitry includes a simple one-position trigger switch which is operated independently of the frequency control probe and the amplitude control potentiometers to turn on the VCA. The trigger switch may be a simple push-button, in which case the VCA is turned on by pressing the push-button and then goes through a predetermined cycle concluded by its turning itself off or, if the VCA has a "sustain" control which is in the "on" position, remains on until pressure is removed from the push-button. The synthesizer circuitry also includes a jack for plugging in another external trigger switch or trigger source.

It will be appreciated that manual operation of the synthesizer can become quite complicated, in that in order to vary frequency and amplitude independently it is necessary to adjust the potentiometer and move the probe independently and accordingly this may require use of more than one hand. The additional need to control the trigger push-button at this time clearly leads to even further difficulty.

According to one aspect of the present invention there is provided an electrical control device comprising a base member, an elongate support member mounted to be movable transversely of its length with respect to said base member, biasing means to bias the elongate member against movement in one direction transversely of its length and towards a null position, and a potentiometer comprising an elongate resistive member supported by and extending along the length of the support member and a sensing electrode which can be applied to the resistive member at a position intermediate its ends when said ends are connected to opposite respective poles of a voltage source to tap off a voltage which is selectively variable by varying the position along the support member at which the sensing electrode is applied to the resistive member, said resistive member being so arranged with respect to said support member that application of the sensing electrode to the resistive member tends to bring about movement of said elongate member with respect to said base member in said one direction, in opposition to said biasing means, and the device also comprising position pick-up means having a first part connected to said support member and a second part connected to said base member, said parts being arranged and connected to generate an electrical analog signal dependent on the position of said support member with respect to said base member, and the device also being provided with means for generating a predetermined response when said support member is moved from said null position thrugh an initiating threshold position against said biasing means and for terminating said predetermined response when said support member is returned from beyond said initiating threshold position towards said null position through a terminating threshold position.

According to another aspect of the present invention there is provided an electrical signal-producing instrument, comprising signal-generator means for generating an electrical signal at a selected frequency between two terminals of the signal-generator means, a transducer device connected to said terminals to receive the signal at said selected frequency and transform the electrical signal energy into a different form, and a variable resistor connected between said terminals to enable the electrical signal applied by said signal-generator means to said transducer device to be attenuated to a selectively variable degree.

For a better understanding of the invention, and to show how the same may be carried into effect, reference will now be made, by way of example, to the accompanying drawings which FIG. 1 shows diagrammatically a simple form of music synthesizer;

FIG. 2 shows a vertical sectional view of a control device embodying the first aspect of the present invention, while FIG. 2A shows a detail of FIG. 2;

FIG. 3 shows an elevation view of the device in the direction of the arrow III shown in FIG. 2;

FIG. 4 shows the electrical arrangement of one part of the control device illustrated in FIG. 2;

FIG. 5 shows the electrical arrangement of another part of the control device; and FIG. 6 shows a modified form of the electrical arrangement shown in FIG. 5, while FIG. 6A shows modifications made to the control device to accommodate the modified electrical arrangement.

The music synthesizer illustrated in FIG. 1 comprises a voltage controlled oscillator (VCO) 20 with two outputs (one providing a square wave signal and the other providing a triangular wave signal) and having both a range potentiometer 27, and two amplitude-control potentiometers 28/28' (to attenuate the signals provided by the two outputs respectively) and a voltage controlled filter (VCF) 21. For the sake of clarity, only one of the outputs of the VCO is shown. The VCO and VCF are arranged and connected so that either or both can respond to a control voltage from a frequency-control voltage source 22, for example a potentiometer. The output of the VCO and/or VCF is connected to a voltage controlled amplifier (VCA) 23, which receives its control voltage from a trigger source 24. The output of the VCA 23 is then passed through an output amplifier 29 to an earphone 32, a recording device 31 or a power amplifier 30 followed by a loudspeaker 26. This layout is based on that of the "Gnome" synthesizer, manufactured by PAIA Electronics.

In the case of the "Gnome" synthesizer, the frequency-control voltage source 22 is a conductive probe which is applied to a strip of resistive material, having its ends connected to a DC voltage source, to tap off a desired frequency-control voltage. The trigger source 24 is a simple push-button switch. In order to operate the "Gnome" synthesizer, the push-button switch is depressed, the probe is applied to the resistive strip and adjusted to produce a desired frequency, and the two amplitude control potentiometers are adjusted to produce the desired volume output. The control device illustrated in FIG. 2 enables all three of these functions (triggering, frequency control and total volume control) to be effected using the pressure of a single finger.

The control device comprises a base 1 which is connected by means of a hinge 2 to an elongate slat 3 of essentially rigid material. As shown, the slat is horizontal, but it can be pivoted in the counter-clockwise direction (as see in FIG. 2) by applying finger pressure to the left-hand edge of the slat. A tension spring 4 connected between the slat 3 and the base 1 resists such pivotal movement of the slat and tends to restore it to its horizontal position.

The slat 3 is provided along the left-hand edge of its upper surface with a frequency control strip 5 which is illustrated to a greatly enlarged scale in FIG. 2A. The frequency control strip comprises a metal strip 6 secured by adhesive on its underside to the upper surface of the slat 3, two lengths of spacer strip 7, for example double adhesive tape, covering the edges of the metal strip 6 but leaving the central area exposed, a resistive strip comprising a length of recording tape 8 having its edges secured to the spacer strips 7 of double adhesive tape and having its magnetic emulsion on its under surface, and a protective covering 9 of electrically non-conductive rayon ribbon.

Normally, the spacer strips 7 of double adhesive tape keep the recording tape 8 spaced from the strip 6. However, when pressure is applied to the covering 9, the recording tape 8 is pressed onto the strip 6 and establishes electrical connection therewith.

The electrical arrangement of the strip 6 and the tape 8, which constitute the active parts of the frequency-control voltage source 22, is illustrated in FIG. 4. Thus, the opposite ends of the tape 8 are connected, through a variable range control resistor 10 and a diode drop 33 respectively to the positive and negative poles of a DC voltage source. The metal strip 6 effectively constitutes a wiper contact which taps off from the tape 8 a voltage dependent upon the position along the slat 3 at which pressure is applied to the covering 9, and applies that voltage to the VCO and/or VCF of the electronic music synthesizer.

The recording tape actually used is Scotch No. 208 having a resistance of about 50,000 ohms/inch. The tape is bridged with a resistor in order to render more linear the relationship between the frequency and position, along the tape, at which contact is made when the control device is connected to the circuitry of the "Gnome" synthesizer.

The slat 3 carries, near its right edge as shown in FIG. 2, a pair of light-emitting diodes 11 and 12, (each an Archer 276-091 having a point source and a clear lens) and the base 1 carries two light detectors 13 and 14 mounted to receive the light output from the LEDs 11 and 12 respectively.

The electrical arrangement of the LEDs 11 and 12 and the light detectors 13 and 14 is shown in FIG. 5. The light detector 13 is a light dependent resistor which constitutes the active partof a variable attenuator which is connected across the output of the output amplifier 29. The LDR 13 is connected in a T-network with two resistors which are included in order to compensate for the low light output of the LED 11. Without the resistors, the maximum attenuation obtained may be lower than desired. The need for the resistors could be avoided by using a brighter light source 11 or a more sensitive light sensor 13.

The light detector 14 is a photodiode (Archer 276-1602) which is connected to a Schmitt trigger circuit 15 comprising an integrated circuit pack of type 555 connected so as to function as a Schmitt trigger. The output of the Schmitt trigger circuit 15 is connected through an optoisolator, comprising a light-emitting diode 16 (Archer 276-047 jumbo LED with a diffused lens) and a light dependent resistor 17, to the terminals of the synthesizer's trigger switch.

When the slat 3 is in the position shown in FIG. 2, the light beams of the LEDs 11 and 12 are beamed full onto the light detectors 13 and 14 respectively. Thus, the LDR 13 has a minimal resistance and the sythesizer's audio output is effectively short-circuited. The photodiode 14 is highly conductive, and accordingly its anode/cathode drop is low. The Schmitt trigger circuit 15 is set to provide a low output under these circumstances. When the left-hand edge of the slat 3 is depressed, the output beams from the LEDs 11 and 12 are no longer directed full onto the light detectors 13 and 14, and accordingly the resistance of the LDR 13 increases and the photodiode 14 becomes less conductive and its anode/cathode drop increases. The trigger circuit 15 is so arranged that when the left-hand edge of the slat has been slightly depressed, through an initiating threshold position, the output of the trigger circuit increases sharply to a high level and accordingly the LED 16 promptly illuminates the LDR 17, the resistance of which drops sharply. The LDR 17 is the active part of the trigger source 24, replacing the push-button switch employed in the "Gnome" synthesizer, and illumination of the LDR has the effect of turning on the VCA 23 of the synthesizer. Reduction of the illumination of the LDR 13 has the effect of decreasing the attenuation of the synthesizer's audio output, thus increasing the amplitude of the output signal reaching the earphones, recording device or loudspeaker.

The Schmitt trigger circuit 15 is such that the terminating threshold position of the slat 3, i.e. the position through which the slat must move in order to cause the output of the trigger circuit to return to its low value, lies between the horizontal or null position of the slat and the initiating threshold position. However, with a different type of trigger circuit the initiating threshold position and the terminating threshold position may be coincident.

The VCA remains on for a predetermined time after the output of the Schmitt trigger circuit 15 goes high and at the end of the predetermined time the VCA is turned off, even if the Schmitt trigger circuit output is still high, unless the VCA has a "sustain" switch which is in the "on" position, in which case the VCA remains on so long as the Schmitt trigger circuit has a high output and turns off when the output of the trigger circuit goes low.

When the VCA is on, the greater the counterclockwise rotation of the slat 3, the greater is the ultimate output amplitude of the synthesizer.

Accordingly, by applying pressure to the rayon ribbon 9 so as to rotate the slat beyond its initiating threshold position, the VCA is switched on and the VCO and/or VCF receives a frequency control voltage whose amplitude depends upon the position at which pressure is applied to the rayon ribbon 9, and the amplitude of the synthesizer's audio output depends upon the angle through which the slat is rotated. Thus, by applying just one finger to the rayon ribbon 9, the operator of the synthesizer can automatically trigger the VCA and can control continously and simultaneously the frequency and amplitude.

The illustrated control device provides the usual advantages of a linear controller over a keyboard, including the capabilities of making swift and subtle changes of intonation and of producing a true vibrato (continuous fluctuating frequency) while also making it possible to achieve a tremolo (continuous fluctuating loudness) and also individual accents, crescendos, diminuendoes and terrace dynamics. By carefully adjusting the VCO range potentiometer 27 and the variable range control resistor 10 it is possible to produce a particular three-octave chromatic scale on an 18-inch control strip within which, at that specific control setting, the space between two adjacent notes on the control strip remains almost constant throughout the entire length of the control strip. This makes it possible to achive tempred chromatic scale tempered as easily using the illustrated control device as when using a keyboard unit.

FIG. 6 illustrates a modified version of the circuit shown in FIG. 5. In FIG. 6, the LED 11 and the LDR 13 are not mounted on the slat 3 and the base 1 respectively but are fixed relative to each other. Moreover, the LED 11 is connected across the collector and emitter of a transistor 18, the base of which is connected to the cathode of the photodiode 14. A further LED 19 (Archer 276-091 with point source and clear lens) is connected in parallel with the LED 11, and illuminates a second photodiode 14' (Archer 276-1602). The LED 19 and the photodiode 14' form an opto-isolator and the photodiode 14' is connected to the Schmitt trigger circuit 15 whose output is connected to the opto-isolator comprising the LED 16 and the LDR 17.

A further distinction between the FIG. 6 arrangement and that of FIG. 5 is that in the case of FIG. 6 the LED 12 and the photodiode 14 are so disposed that the illumination of the photodiode is increased as the angle of rotation is increased (as illustrated in FIG. 6A), and therefore the anode/cathode drop across the photodiode 14 is decreased until the left-hand edge of the slat 3 is depressed as far as it will go. The transistor 18 serves as an inverter, and accordingly as the illumination of the photodiode 14 increases the illumintion of the LDR 13 and the photodiode 14' by the LEDs 11 and 19 respectively decreases. Thus, the effect of the counter-clockwise rotation of the slat on the resistance of the LDR 13 and resistance of the LDR 17 is the same in the case of FIG. 6 as in the case of FIG. 5.

This more complex circuit has the advantage that it eliminates the need to coordinate the positions of two different light sources on the movable slat.

The purpose of the opto-isolators 16/17 and 19/14' is to eliminte feedback or leakage between the various stages of the device.

It will be appreciated that the photodiodes 14 (FIGS. 5 and 6) and 14' (FIG. 6) could, if desired, be replaced by light dependent resistors.

In a further modification of the control device, the source(s) and sensor(s) are mounted in relatively fixed positions and a moving shutter controlled by the angular position of the slat is used to vary the intensity of the light beam received by the (or each) sensor.

The source/sensor pair(s) employed in FIGS. 2 to 5 and 6 could be replaced by non-optical means. For example each signal source could be replaced by a magnet and each signal sensor by a field coil; or each sensor could be replaced by a piezoelectric device and each source by means for applying pressure to the associated piezoelectric device.

It is to be understood that the invention is not limited to the specific constructions shown and described, as it will be apparent to those skilled in the art that changes may be maade without departing from the principles of the invention as defined in the appended claims.

I claim:

1. An electrical control device comprising a base member, an elongate support member mounted to be movable transversely of its length with respect to said base member, biasing means to bias the support member against movement away from a null position in one direction transversely of its length, and a potentiometer comprising an elongate resistive member supported by and extending along the length of the support member and a sensing electrode which can be applied to the resistive member at a position intermediate its ends when said ends are connected to opposite respective poles of a voltage source to tap off a voltage which is selectively variable by varying the position along the support member at which the sensing electrode is applied to the resistive member, said resistive member being so arranged with respect to said support member that application of the sensing electrode to the resistive member tends to bring about movement of said elongate member with respect to said base member in said one direction, in opposition to said biasing means, and the device also comprising position pick-up means having a first part connected to said support member and a second part connected to said base member, said parts being arranged and connected to generate an electrical analog signal dependent on the position of said support member with respect to said base member, and the device also being provided with means for generating a predetermined response when said support member is moved from said null position through an initiating threshold position against said biasing means and for terminating said predetermined response when said support member is ruturned from beyond said initiating threshold position towards said null position through a termination threshold position.

2. A device as claimed in claim 1, wherein said position pick-up means are optical, one of said parts comprising light source means and the other of said parts comprising light sensor means.

3. A device as claimed in claim 1, wherein said means for generating a predetermined response comprise second position pick-up means having a first part connected to said support member and a second part connected to said base member, said parts being arranged and connected to produce an analog signal, and trigger circuitry connected to receive said analog signal produced by said second position pick-up means and provide a digital response when the analog signal received thereby indicates that the support member has moved from before said termination threshold position through said initiating threshold position and to terminate said digital response when the analog signal received by the trigger circuitry indicates that the support member has moved from beyond said initiating threshold position through said termination threshold position.

4. A device as claimed in claim 1, wherein said means for generating a predetermined response comprise trigger circuitry connected to receive said analog signal and provide a digital response when the analog signal indicates that the support member has moved from before said termination threshold position through said initiating threshold position and to terminate said digital response when the analog signal indicates that the support member has moved from beyond said initiating threshold position through said termination threshold position.

5. A device as claimed in claim 1, wherein said sensing electrode comprises a strip of conductive material extending adjacent to but spaced from said resistive member, and said resistive member is flexible so that it can be pressed into electrical contact with said strip of conductive material.

6. A device as claimed in claim 1, wherein said initiating threshold position is substantially the same as said termination threshold position.

7. A device as claimed in claim 1, wherein said initiating threshold position lies beyond said termination threshold position.

8. An electronic musical instrument, comprising a control device as claimed in claim 1, means connected to said sensing electrode to generate an electrical signal at a frequency dependent on the voltage tapped off from the resistive member by the sensing electrode, amplifying means connected to receive said electrical signal and operative to amplify said electrical signal if said predetermined response is generated, and amplitude modifying means connected to receive the amplified electrical signal from said amplifying means and modify its amplitude in dependence upon the voltage value of said analog signal.

9. A device as claimed in claim 2, wherein said light source means comprise a light emitting diode and said light sensor means comprise a light dependent resistor.

10. A device as claimed in claim 3, wherein said second position pick-up means are optical, one of said parts comprising light source means and the other of said parts comprising light sensor means.

11. A device as claimed in claim 10, wherein said light source means comprise a light emitting diode and said light sensor means comprise a photodiode.

* * * * *